United States Patent [19]

Leroy et al.

[11] 4,157,813

[45] Jun. 12, 1979

[54] PROCESS FOR PROTECTING A METALLURGICAL TUYERE AGAINST WEAR WHILE MINIMIZING THE AMOUNT OF LIQUID COOLING AGENT SUPPLIED THERETO

[75] Inventors: Pierre J. Leroy, St. Germain en Laye; Emile Sprunck, Moyeuvre, both of France

[73] Assignee: Creusot-Loire, Paris, France

[21] Appl. No.: 870,373

[22] Filed: Jan. 18, 1978

[30] Foreign Application Priority Data

Jan. 21, 1977 [FR] France ..... 77 01672

[51] Int. Cl.[2] ..... C21B 7/16

[52] U.S. Cl. ..... 266/47; 266/46; 266/270

[58] Field of Search ..... 75/52, 60; 266/44, 46, 266/47, 188, 265, 268, 270

[56] References Cited

U.S. PATENT DOCUMENTS 3,817,744 6/1974 Leroy et al. ..... 266/46 X

*Primary Examiner*—Roy Lake
*Assistant Examiner*—Paul A. Bell
*Attorney, Agent, or Firm*—Robert D. Yeager

[57] ABSTRACT

An improved process for reducing the rate of wear and for minimizing the amount of liquid cooling agent supplied to a tuyere used for blowing oxidizing gas in the refining of molten metal. The fluid passageway of the tuyere is provided with an outlet having a reduced cross-sectional area and the cooling agent is injected at a flow rate between 0.05 and 0.14 liters per minute per centimeter of the circumference of the fluid passageway.

2 Claims, 3 Drawing Figures

PROCESS FOR PROTECTING A METALLURGICAL TUYERE AGAINST WEAR WHILE MINIMIZING THE AMOUNT OF LIQUID COOLING AGENT SUPPLIED THERETO

BACKGROUND OF THE INVENTION

1. Field of the Invention

This invention relates to the protection of tuyeres used in refining liquid metals; more particularly, to the protection of a tuyere that is cooled by injecting a liquid cooling agent through a passageway which is disposed about the periphery of the tuyere.

2. Description of the Prior Art

It is known that a tuyere used to introduce refining substances into a liquid metal bath from beneath the surface thereof may be protected against erosion (due to heat and/or chemical reaction) by injecting fluids through passageways surrounding the central tube of the tuyere. The protective fluids may be either liquid or gaseous, but the present invention concerns only liquid protection. The liquid form of tuyere protection is exemplified by U.S. Pat. No. 3,817,744 in which there is disclosed a tuyere consisting of two concentric tubes; oxidizing gas is blown through the central tube and liquid cooling agent is injected through the annular passageway therebetween. A variety of liquids may be used as the cooling agent for such tuyeres including water, liquid hydrocarbons (e.g. fuel oil), liquid butane, liquid carbon dioxide, and others; mixtures or emulsions of liquids advantageously may be used.

It is also known, for example where liquid-protected concentric tuyeres are used for blowing oxygen into a steel-making converter from below the surface of the molten iron bath contained therein, that the pressures and flow rates of the liquid cooling agents are adjusted to give optimum tuyere wear rates but that these variables of pressure and flow rate ultimately depend on the cross-sectional area of the tuyere passageway that is available for liquid flow. Conventional tuyere construction has found this cross-sectional area to approximate 10 square millimeters or more per centimeter of mean circumference of the annular passageway available for liquid flow. Thus, for example, with such conventional concentric tuyeres operating in a steelmaking converter and being cooled with domestic fuel oil, the fuel oil flow rates range from 0.13 to 0.15 liters per minute per centimeter of mean circumference (of the annular passageway) and the pressure of the fuel oil introduced into the passageway ranges between about 4 and 8 bars. Under these conditions, which are considered normal for steelmaking operations, the rate of wear of the discharge end of the tuyere is of the order of 8 to 10 millimeters per hour of oxygen blowing.

Workers in the art have sought to achieve even better rates of wear for liquid protected tuyeres. Any improvements achieved in this regard strongly contribute to extending the life of the refractory lining in which these tuyeres are embedded and, as is well known, refractory life is an important economic factor in any metallurgical operation. The efforts of workers in the art toward this end, however, have been directed mainly at increasing the total flow of cooling agent in the annular passageway, the apparent thinking being that the more cooling agent used, the better the heat transfer characteristics of the system and thus a consequent reduction in tuyere wear. For this reason, it is not uncommon for a conventional concentric tuyere to have an annular space between the two tubes of 1 to 1.5 millimeters in order to accomodate such flow. Because the liquid cooling agent is consumed in the metallurgical operation and does not otherwise contribute to (or detract from) the chemical reactions taking place in the operation, any increase in the consumption of liquid cooling agent, particularly when it is fuel oil, is economically undesirable.

SUMMARY OF THE INVENTION

The present invention overcomes the shortcomings experienced by the efforts just described, and indeed, results in dramatic improvements over conventional practice by both minimizing the amount of cooling agent supplied to the fluid passageway of the tuyere and decreasing the wear rate at the discharge end of the tuyere.

The present invention provides, in the introduction of a stream of oxidizing gas into a bath of molten metal through a tuyere submerged in the bath, wherein the discharge end of the tuyere is cooled by injecting a liquid cooling agent through a fluid passageway disposed peripherally of the tuyere, an improved process for minimizing the amount of liquid cooling agent supplied to the fluid passageway with an accompanying decrease in the wear rate of the discharge end of the tuyere during the introduction of the oxidizing gas into the molten metal, the aforesaid improvement comprising: providing, at the discharge end of the tuyere, an outlet for the fluid passageway having a cross-sectional area not exceeding 2 square millimeters ($mm^2$) per centimeter of circumference of the fluid passageway; and injecting the cooling agent into the fluid passageway at a pressure to achieve a flow rate therethrough of 0.05 to 0.14 liters per minute per centimeter of the aforesaid circumference. The term "circumference" as used in this Summary and hereinafter with respect to a fluid passageway is intended to mean the circumference of the outer of the two walls defining the fluid passageway.

In view of the provision of such a small flow cross-section in the present invention, the protective liquid is introduced into the fluid passageway of the tuyere at a relatively high pressure to allow for the considerable pressure drop experienced along the length of the fluid passageway. This introduction pressure should be at least 15 bars and preferably much higher, for example in the range of 30 to 50 bars. The pressure will vary within these ranges in accordance with the nature and viscosity of the protective fluid. Liquid carbon dioxide, for example, should be introduced at a pressure between 30 and 50 bars and at a flow rate between 0.09 and 0.14 liters per minute per centimeter of circumference to ensure that it remains in the liquid state in the tuyere.

The flow rate for the protective liquid of 0.05 to 0.14 liters per minute per centimeter of fluid passageway circumference applies in cases in which the oxidizing gas in the central tube of the tuyere is pure oxygen being blown at an effective pressure no exceeding 10 bars (as measured upstream of the tuyere). When the effective oxygen pressure exceeds 10 bars, a region of extremely high temperature may be produced in the metal bath near the discharge end of the tuyere. In such cases, the established flow rate of protective liquid should be increased by multiplying them times $\sqrt{p/10}$ (wherein p is the effective oxygen pressure) without modifying the flow cross-section of the fluid passageway.

When the pure oxygen being blown has powder suspended therein, e.g. lime powder, the powder has a cooling effect on the metal bath. In this case, the established flow rate of protective liquid should be decreased by an amount determined by the flow rate of powder.

The present invention features, therefore, introducing the protective liquid at relatively high pressure into a narrow flow cross-section; the high pressure ensures a highly efficient mass cooling effect over the entire circumference of the tuyere; the narrow flow cross-section ensures that the flow rate of protective fluid is low, thereby minimizing the consumption of protective liquid per ton of metal refined.

An unexpected result achieved by the present invention is that, although the consumption of protective liquid is significantly reduced compared with prior art practices, the wear rate of the discharge end of the tuyere is retarded considerably in comparison with prior art results and, indeed, is practically stopped in some cases. Accordingly, the life of the refractory bottom or lining surrounding tuyeres utilizing the present invention is substantially increased.

Furthermore, it has been found quite to the surprise of workers skilled in the art that if the injection pressure of the protective liquid is sufficiently high, the efficient distribution of protection around the jet of oxidizing gas issuing from the tuyere is more important in terms of tuyere wear rate than the heat transfer cooling effect of the protective liquid. In other words the tuyere is provided with better protection by the present invention even while the consumption of protective liquid is being reduced.

These excellent results are achieved only with very small flow cross-sections; e.g. an annular flow cross-section for protective liquid having a width of the order of 0.1 millimeter or even less. Such cross-sections are from 10 to 15 times smaller than the flow cross-sections provided in conventional tuyeres.

BRIEF DESCRIPTION OF THE DRAWINGS

Other features and advantages of the present invention will be more fully understood from the following description, considered together with the accompanying drawings, in which.

DESCRIPTION OF THE PREFERRED EMBODIMENTS

The structural details of a tuyere for use in practicing the present invention may vary widely within the principles set forth above. Two particularly convenient types of construction, however, involve, on the one hand, a continuous fluid passageway outlet at the discharge end of the tuyere, and a discontinuous outlet on the other.

The first type of tuyere construction includes at least two concentric tubes providing a central passage for oxidizing gas and a peripheral passage means between the walls of the two tubes for protective liquid. The peripheral passage is substantially uninterrupted throughout its circumference. The total flow cross-section of the peripheral passage at its outlet does not exceed 2 square millimeters per centimeter of circumference of the inner wall of the outer tube of the tuyere and preferably is between 1.2 and 0.6 square millimeters.

The second type of tuyere construction also involves a central passageway for oxidizing gas but has peripheral passage means that is not circumferentially continuous. This type of tuyere may be formed of two concentric tubes with discontinuous passage spaced peripherally about the central passage or may be formed of a single tube with a ring discrete longitudinal ducts machined in the tube wall peripherally of the central passage. In this second type of construction, the total cross-section of the peripheral discontinuous passageways should not exceed 2 square millimeters per centimeter of the mean circumference of the ring of discontinuous passageways and preferably is between 1.2 and 0.6 square millimeters. The discontinuous passageways may be of any desired configuration.

Figure 1:
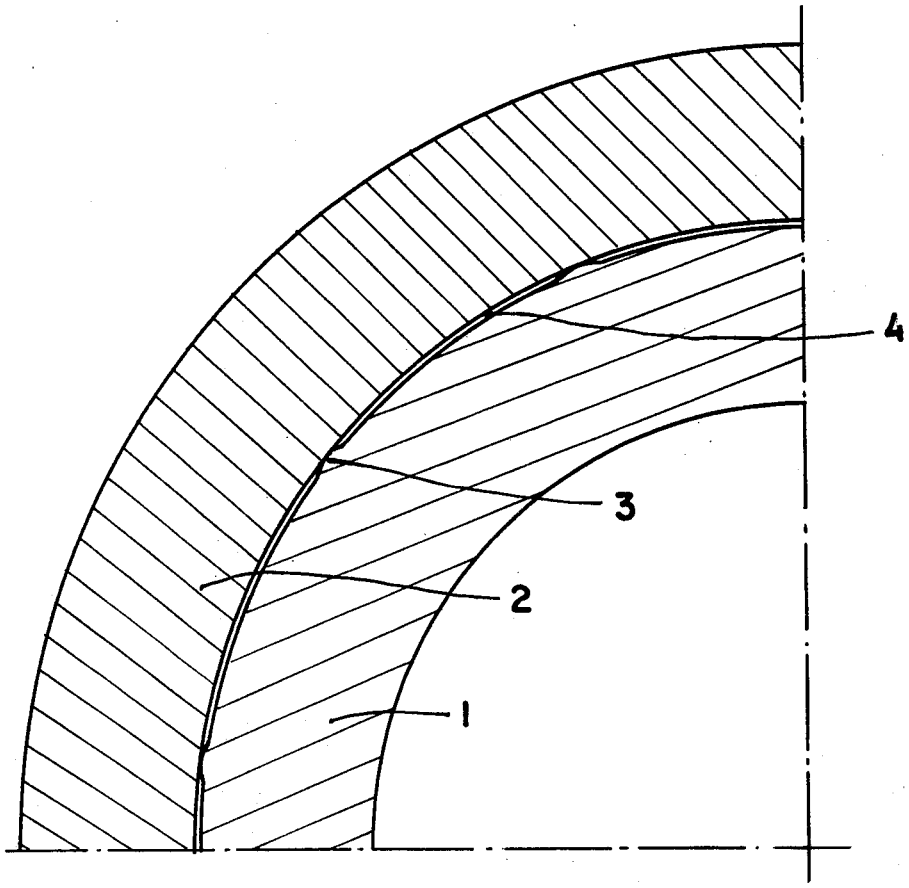
FIG. 1 is an enlarged quarter of a cross-section through an embodiment of a tuyere for use in the present invention.

Referring now to the drawings, the tuyere of FIG. 1 comprises an inner tube 1 having an inner diameter of 28 millimeters and an outer diameter of 38 millimeters. The outer tube 2 has an inner diameter of 38.2 millimeters and an outer diameter of 48 millimeters. The inner tube 1 is centered in the outer tube 2 by means of regularly spaced longitudinally extending ridges 3 which project from the inner tube.

The protective liquid flows through the annular space between the tubes 1 and 2 and the total flow cross-section of the protective liquid is equal to the sum of the constituent portions 4 between the ridges 3 and its approximately 11 square millimeters in the present embodiment. The cross-section extends around a circumference 12 centimeters. The length of the tuyere is 1,010 mm.

Figure 2:
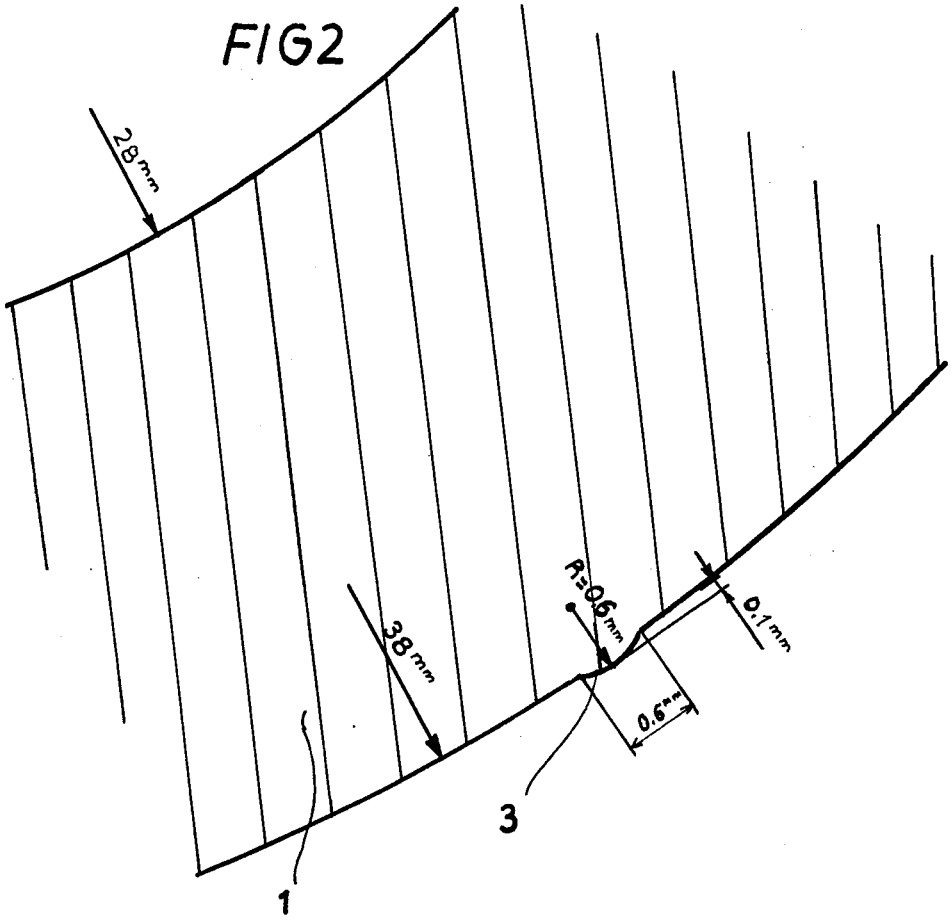
FIG. 2 illustrates details of a portion of the tuyere shown in FIG. 1.

The centering ridges 3 can have various geometrical shapes. A preferred ridge 3 is shown in FIG. 2. The ridge 3 has a round cross-section having a radius of 0.6 millimeters, a width at its base of 0.6 millimeters and a height of 0.1 mm. The circumferential distance between each pair of adjacent ridges is 11.9 mm. i.e. there are 10 such ridges on the circumference of the tube 1 which has a diameter of 38 mm.

Figure 3:
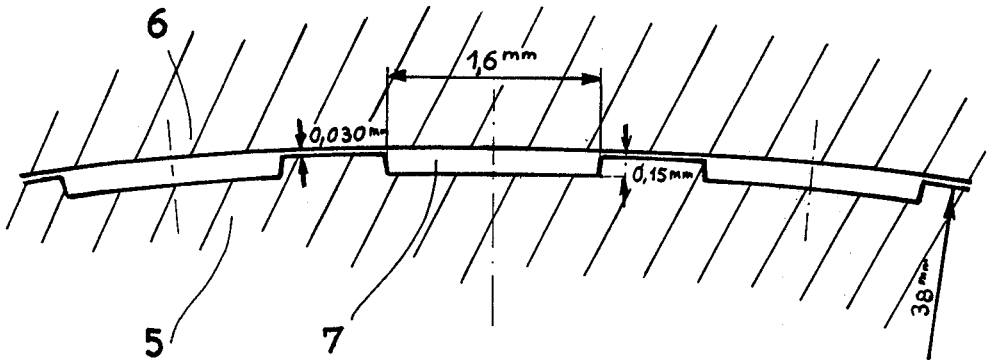
FIG. 3 is a fragmentary cross-section through another embodiment of a tuyere for use in the present invention.

The tuyere of FIG. 3 comprises an inner tube 5 and an outer tube 6, the space between the tubes for the protective liquid being provided by longitudinal grooves 7 in the outer surface of the inner tube. The grooves 7 are regularly spaced over the circumference of the tube 5. In a preferred embodiment, the inner tube 5 has an inner diameter of 28 mm and an outer diameter of 38 mm; the inner tube 55 has a maximum clearance of 0.030 mm relative to the outer tube 6. The grooves 7 in the tube 5 are 1.6 mm wide and 0.15 mm deep. The grooves are separated by intervals of 2.38 mm, so that tube 5 has 50 of grooves 7 on its outer surface.

EXAMPLE

For the refining of steel in a bottom blow converter, a tuyere as shown either in FIG. 1 or in FIG. 3 can be used as follows with regard to the introduction of protective liquid which in this Example is fuel oil:

(a) From the beginning of refining until the carbon content in the metal bath is of the order of 0.500%, the protective liquid is introduced at a pressure of 29 bars and the flow rate is 0.054 liters per minute per centimeter of circumference, i.e.:

$0.054 \times 12 = 0.65$ liters of protective liquid flow per minute in the tuyere in question.

(b) Below a carbon content of 0.50%, until the end of the refining operation, the protective liquid is introduced at a pressure of 44 bars and the flow rate of the liquid is 0.083 liters per minute per centimeter of circumference, i.e. $0.083 \times 12 = 1$ liter of protective liquid flow per minute in the tuyere in question.

In the case of a blowing operation in which phase (a) lasts 9 minutes and the phase (b) lasts 3 minutes, the consumption of protective liquid per tuyere is $0.65 \times 9 + 1 \times 3 = 5.85 + 3 = 8.85$ liters, compared with $0.9 \times 9 + 1.6 \times 3 = 8.1 + 4.8 = 12.9$ liters for a conventional tuyere of the same size. Consequently, the improvement in the liquid consumption is $12.9 - 8.85 = 4.05$ liters per tuyere, i.e. $4.05/12.9 = 31\%$.

In the refining of steel, it is particularly advantageous to utilize a flow rate of protective liquid of 0.05 to 0.06 liters per minute per centimeter of fluid passageway circumference while the carbon content of the metal bath is about 0.05% carbon or above. When the carbon content is reduced below 0.50%, the flow rate should be adjusted to 0.08 to 0.14 liters per minute etc.

Improved protective liquid consumption is one advantage achieved in this Example. The main advantage, however, is that the rate of wear on the tuyere is greatly reduced and that the tuyeres and the bottoms of the refining converter last considerably longer, the service life in some cases being equal to that of the lining surrounding the sides of the converter.

The present invention is particularly applicable to the refining of steel, but is also applicable to the refining of ferrous alloys and the coarse non-ferrous metals. In view of the reduced flow sections for the protective liquid, the use of the present invention in such operations should be supplemented by the blowing of a scavenging gas, e.g. nitrogen, at a pressure of about 10 bars through the protective passages during the times when protective liquid is not in use, e.g. between two successive metallurgical operations when the main refining fluid (e.g. pure oxygen) is cut off.

We claim:

1. In the introduction of a stream of oxidizing gas into a bath of molten metal through a tuyere submerged in said bath, wherein the discharge end of said tuyere is cooled by injecting a liquid cooling agent through a fluid passageway disposed peripherally of said tuyere, an improved process for minimizing the amount of liquid cooling agent supplied to said fluid passageway with an accompanying decrease in the wear rate of said discharge end of said tuyere during the introduction of said oxidizing gas into said molten metal, said improvement comprising:

providing, at the discharge end of said tuyere, an outlet for said fluid passageway having a cross-sectional area not exceeding 2 square millimeters per centimeter of circumference of said fluid passageway; and injecting said cooling agent into said fluid passageway at a pressure to achieve a flow rate therethrough of 0.05 to 0.14 liters per minute per centimeter of said circumference.

2. In the introduction of a stream of pure oxygen without powder in suspension into a bath of molten metal through a tuyere submerged in said bath at an effective pressure exceeding 10 bars, wherein the discharge end of said tuyere is cooled by injecting a liquid cooling agent through a fluid passageway disposed peripherally of said tuyere, an improved process for minimizing the amount of liquid cooling agent supplied to said fluid passageway with an accompanying decrease in the wear rate of said discharge end of said tuyere during the introduction of said oxidizing gas into said molten metal, said improvement comprising:

providing at the discharge end of said tuyere, an outlet for said fluid passageway having a cross-sectional area not exceeding 2 square millimeters per centimeter of circumference of said fluid passageway; and injecting said cooling agent into said fluid passageway at a pressure to achieve a flow rate therethrough of $0.05\sqrt{p/10}$ to $0.14\sqrt{p/10}$ liters per minute per centimeter of said circumference, wherein p is the effective pressure of said pure oxygen.

* * * * *

UNITED STATES PATENT AND TRADEMARK OFFICE

CERTIFICATE OF CORRECTION

PATENT NO. : 4,157,813

DATED : June 12, 1979

INVENTOR(S) : PIERRE JEAN LEROY et al.

It is certified that error appears in the above-identified patent and that said Letters Patent are hereby corrected as shown below:

Column 4, line 51, "55" should read --5--.

Column 5, line 19, "0.05%" should read --0.50%--

Signed and Sealed this

*Eleventh* Day of *September 1979*

[SEAL]

*Attest:*

*Attesting Officer*

LUTRELLE F. PARKER

*Acting Commissioner of Patents and Trademarks*